US005148749A

United States Patent [19]

Maes et al.

[11] Patent Number: 5,148,749

[45] Date of Patent: Sep. 22, 1992

[54] PRIMING CHAMBER FOR A FIREARM CARTRIDGE

[76] Inventors: Félix-Victor Maes; Jean-Paul Lechanteur, both of Levée Gérard 17, 4650 Chaineux, Belgium

[21] Appl. No.: 619,755

[22] Filed: Nov. 28, 1990

[30] Foreign Application Priority Data

Nov. 29, 1989 [BE] Belgium ..... 08901275

[51] Int. Cl.[5] ..... F42C 19/10

[52] U.S. Cl. ..... 102/204; 102/470

[58] Field of Search ..... 102/204, 470

[56] References Cited

U.S. PATENT DOCUMENTS

| | | | |
|---|---|---|---|
| 932,562 | 8/1909 | Muenzenmaier | 102/470 |
| 3,195,463 | 7/1965 | Foote et al. | 102/204 |
| 4,029,015 | 6/1977 | Lachaussee et al. | 102/204 |
| 4,315,462 | 2/1982 | Vollers | 102/204 |

FOREIGN PATENT DOCUMENTS

| | | | |
|---|---|---|---|
| 752333 | 8/1970 | Belgium | 102/470 |
| 2355272 | 1/1978 | France | 102/470 |
| 628995 | 11/1961 | Italy | 102/470 |

*Primary Examiner*—Harold J. Tudor

[57] ABSTRACT

On the inside of a cylindrical envelope, an anvil projects from the base of the envelope and has a flat central member extending parallel to an axial plane of the envelope. Flash-holes are formed in the flat areas of the base on either side of the central member so as to create passages in the vicinity of the axial plane of the cylindrical envelope. The central member has two extensions which have a tapered upper portion and connect to the top of the flat central member, forming a relatively flat end, the lower part of the anvil being connected to the cylindrical envelope, forming an integral part of it.

4 Claims, 2 Drawing Sheets

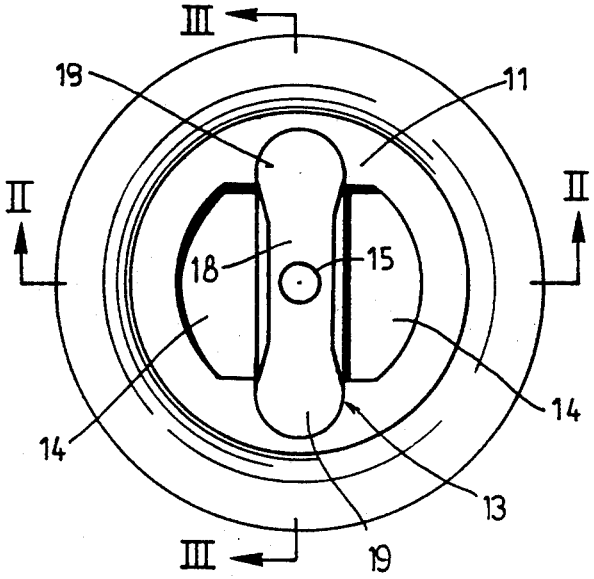
FIG. 1
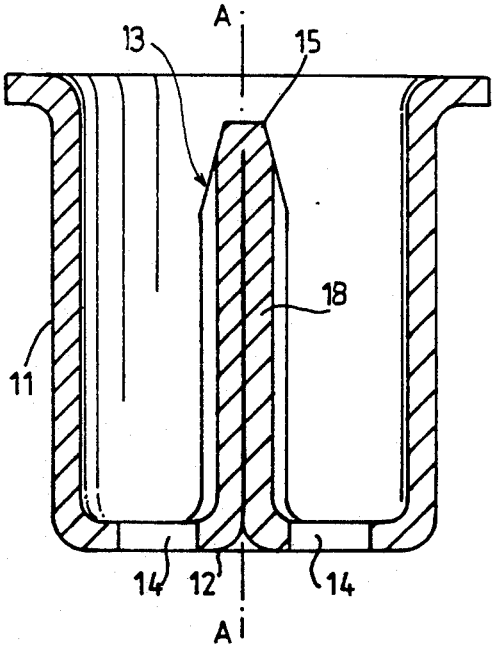
FIG. 2
FIG. 3
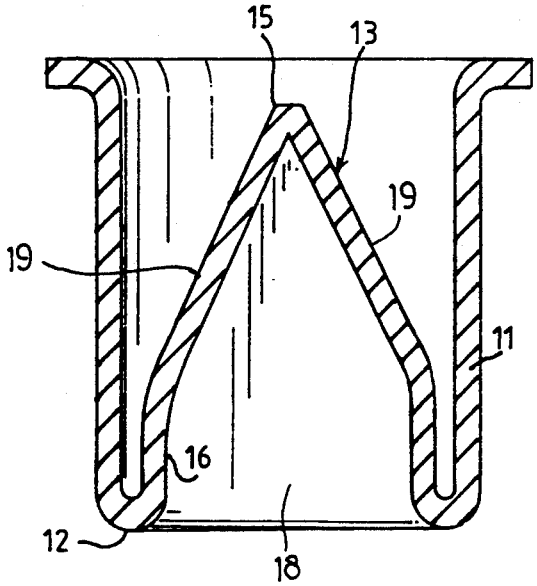

PRIMING CHAMBER FOR A FIREARM CARTRIDGE

FIELD OF THE INVENTION

The present invention relates to a priming chamber for a central impact firearm cartridge.

BACKGROUND OF THE INVENTION

A priming chamber consists of a receptacle designed to accommodate the priming capsule and it is housed in the base of a cartridge case. One type of priming chamber currently used comprises two elements: a cylindrical envelope and an anvil designed to resist the force exerted by the impact element of a firearm.

In a known implementation (see, for example U.S. Pat. No. 4,029,015), the anvil forms an integral part of the cylindrical envelope and the priming chamber comprises a single element. In this embodiment, the anvil has a tapered body, for example conical or pyramidal in shape with a flat end. The lower part of the anvil body, which is connected to the cylindrical envelope, is pierced with a plurality of flash-holes a vent holes disposed around the circumference of the anvil and separated from one another with a predetermined angular spacing. These flash-holes permit the passage of the heat generated by the explosion of the primer resulting from the impact, in order to transfer it to the powder held in the cartridge case so as to effect the propulsion of the projectile.

With this type of priming chamber, it is frequently observed that the powder has difficulty in igniting and the projectile has a relatively low velocity. These flaws are attributed to the arrangement of the flash-holes, which, being disposed along the cylindrical envelope, transfer heat in the direction of the powder in the form of narrow waves of heat which are clearly separated from one another around the circumference of the priming chamber.

SUMMARY OF THE INVENTION

The object of the present invention is to remedy the above-mentioned flaws in known priming chambers and to provide a priming chamber which is able to transfer to the powder charge heat which is adequately concentrated towards the center of the base of the case to allow the powder to ignite quickly.

According to the invention there is provided a priming chamber comprising an anvil which forms an integral part of the cylindrical envelope, said anvil having a flat central member extending parallel to an axial plane of the envelope, the flat areas of the base of the cylindrical envelope having flash-holes disposed on either side of the flat central member to create passages for the priming heat in the vicinity of the axial plane of the cylindrical envelope.

In a preferred embodiment, the central member has two extensions which have a tapered upper portion and connect to the top of the flat central member, forming a relatively flat end, the lower part of the extensions being connected to the cylindrical envelope, forming an integral part of it.

In a particular embodiment, the lower portion of the flat central member body has an indentation which interconnects the flash-holes such that a central flash-hole is formed for the priming heat.

The invention will be understood in more detail in conjunction with the following drawings appended hereto.

BRIEF DESCRIPTION OF THE DRAWINGS

FIG. 1 is a plan view of an embodiment of the priming chamber according to the invention.

FIG. 2 is an axial section along line II—II as shown in FIG. 1.

FIG. 3 is an axial section along line III—III as shown in FIG. 1.

DETAILED DESCRIPTION OF PREFERRED EMBODIMENTS

Figure 4:
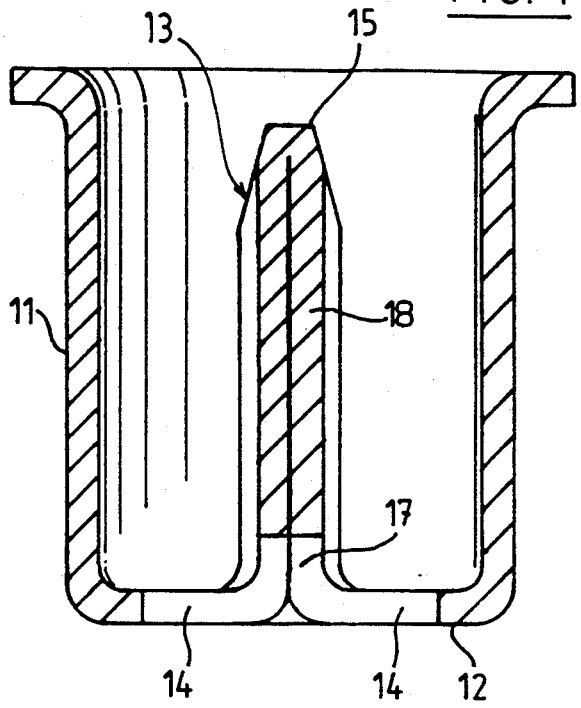
FIGS. 4 and 5 represent an alternative embodiment of the priming chamber shown in FIGS. 1 to 3.

Referring to FIGS. 1 to 3 there is shown a cylindrical envelope 11 having a base 12 pressed to form an anvil 13 projecting towards the inside of the envelope 11. The anvil is formed with a flat central member 18 extending parallel to an axial plane A—A of the envelope 11 (see FIG. 2). Two flash-holes 14 are formed in the flat areas of the base, which are connected to the cylindrical envelope 11 on either side of the central member.

The central member 18 has two extensions 19 which have a tapered upper portion (see FIG. 3) and connect to the top of the central member 18 forming a relatively flat end 15. The lower part 16 of the extensions is connected to the cylindrical envelope 11, forming an integral part of it. The drawing clearly shows that, due to the flat anvil 13 according to the invention, the flash-holes 14 can be brought near to the longitudinal axis A—A of the cylindrical envelope 11. They thus form passages for contiguous waves of heat which concentrate the priming heat onto the central part of the base of the case containing the powder charge. This concentrated heat which is transferred to the powder charge of a cartridge ensures that the powder ignites rapidly, providing the projectile mounted in the head of the cartridge with optimum velocity.

Figure 5:
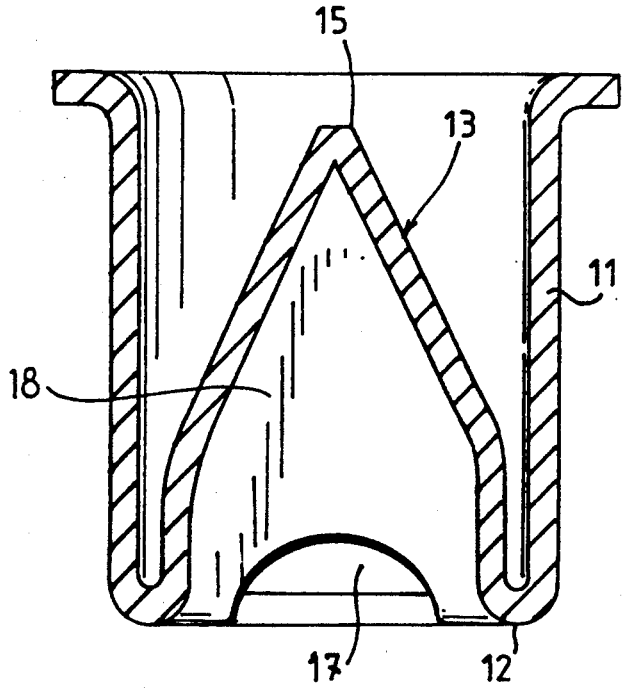

A different embodiment of the priming chamber according to the invention is shown in FIGS. 4 and 5. In this embodiment, the anvil 13 is identical to the one shown in FIGS. 2 and 3. However, the lower part of the central member of the anvil 13 has an indentation 17 which interconnects the flash-holes 14 thus forming a central flash-hole for the priming heat, adding to the desired heat-concentrating effect.

The examples described above are given by way of illustration and the invention is in no way restricted to these examples. Any modification, variant or equivalent arrangement must be deemed to be included within the scope of the invention.

We claim:

1. A pressed one piece priming chamber comprising a cylindrical envelope having a base;

a pair of flat extensions integral with and projecting from said base within said envelope to define a flat central member having a flat end, each of said extensions extending substantially across an internal diameter of said envelope at the base thereof, and opposed flat surfaces of said extensions being in contact with each other along a central axis of said envelope; and a pair of flash holes in said base for expelling heat from within said envelope, said flash holes being located close to said central axis and disposed on opposite sides of said extensions in contact with each other.

2. A priming chamber according to claim 1 wherein each said extension has a tapered upper portion connected at a top to the other of said extensions to form said flat end and a lower part connected to said cylindrical envelope.

3. A priming chamber according to claim 6 wherein said central member has an indentation interconnecting said flash-holes.

4. A priming chamber according to claim 1 wherein said central member has an indentation interconnecting said flash-holes.

* * * * *